United States Patent [19]

Förster et al.

[11] Patent Number: 4,687,566

[45] Date of Patent: Aug. 18, 1987

[54] PROTECTIVE COLLAR FOR ANODE SPADE PIN

[75] Inventors: Ludwig Förster, Bad Säckingen; Alois Franke, Rheinfelden; Reinhard Nobel, Wehr II, all of Fed. Rep. of Germany

[73] Assignee: Swiss Aluminium Ltd., Chippis, Switzerland

[21] Appl. No.: 827,082

[22] Filed: Feb. 7, 1986

[30] Foreign Application Priority Data

Mar. 6, 1985 [CH] Switzerland ..... 1010/85

[51] Int. Cl.[4] ..... C25C 3/08

[52] U.S. Cl. ..... 204/279; 204/243 R

[58] Field of Search ..... 204/67, 243 R, 279, 204/286

[56] References Cited

U.S. PATENT DOCUMENTS

| | | | |
|---|---|---|---|
| 2,528,905 | 11/1950 | Ollivier et al. | 204/243 R |
| 2,680,143 | 6/1954 | Clegg et al. | 204/243 R |
| 3,024,178 | 3/1962 | Sem | 204/243 R |
| 3,202,600 | 8/1965 | Ransley | 204/243 R |
| 3,244,610 | 4/1966 | Brown et al. | 204/279 |
| 3,398,081 | 8/1968 | Bonfils et al. | 204/243 R |
| 3,745,106 | 7/1973 | Jacobs | 204/243 R |
| 3,745,107 | 7/1973 | Jacobs | 204/243 R |
| 4,172,023 | 10/1979 | Friedli et al. | 204/294 |
| 4,247,381 | 1/1981 | Schirnig et al. | 204/279 |
| 4,297,180 | 10/1981 | Foster, Jr. | 204/243 R |
| 4,490,826 | 12/1983 | Kawamata et al. | 204/243 R |
| 4,537,671 | 8/1985 | Zollinger et al. | 204/243 R |

FOREIGN PATENT DOCUMENTS

| | | | |
|---|---|---|---|
| WO84/01178-42 | 9/1984 | PCT Int'l Appl. | 204/243 R |

*Primary Examiner*—John F. Niebling
*Assistant Examiner*—Terryence Chapman
*Attorney, Agent, or Firm*—Bachman and LaPointe

[57] ABSTRACT

A collar for protecting the iron spade of an anode rod for a carbon block that serves as an anode in the electrolytic production of aluminum comprises a plurality of shaped carbon blocks each with two close-fitting, abutting end faces and recesses which jointly correspond in cross-section to that of the anode spade or pin and surround the anode spade or pin projecting out of the anode block; the base areas of the said carbon collar blocks form a plane which is in contact with the carbon anode. The shaped carbon blocks are manufactured out of 60–90 wt % carbonaceous solids and 10–40 wt % bitumen binder. Because of their low pore volume the protective collars exhibit a low absorption capacity for sodium and a favorable combustion behavior during the electrolytic process.

13 Claims, 4 Drawing Figures

PROTECTIVE COLLAR FOR ANODE SPADE PIN

BACKGROUND OF THE INVENTION

The invention relates to a collar for projecting the iron spade of an anode rod for a carbon block that serves as an anode in the electrolytic production of aluminum.

Baked carbon electrodes for fused salt electrolytic production of aluminum from a fluoride electrolyte are usually fitted with anode rods featuring two or four iron spades or pins which are set in the upper part of the carbon anode and secured in place by pouring molten iron around them.

The carbon anode which for example has a cross section of about 500×1500 mm and a height of 400–550 mm, is connected via the iron spade to the anode rod which is in turn connected by clamping means to the electric current source.

On setting the carbon electrode in service in the electrolyte cell, the head of the electrode is heated to about 180° C. After about 6 days the temperature on average has risen to about 400°–500° C. The oxygen released in the electrolytic process causes part of the anode to be burnt off with the result that the anode has to be lowered about 15–20 mm per day. In the course of time the anode has been lowered to such an extent that the iron spades lie below the surface of the molten electrolyte. The end of the spade that is surrounded by the carbon mass is protected, not, however, the part projecting out of the anode. This part of the iron spade projecting out must be protected so that it will not be attacked by and partly dissolved in the electrolyte. This is achieved with the aid of carbonaceous material which poured into a sleeve that runs around the iron spade and is inserted in a recess in the anode.

A suitable form of sleeve for that purpose is a kind of collar made of cardboard or aluminum sheet which can feature two side parts that face each other and project inwards (DE-A 27 56 756) so that they rest clamped against the iron spades. The filter material comprises granules of anthracite, graphite, petroleum coke, metallurgical coke and/or residual lining or spent electrode material which is made into a granular mass or paste with the aid of coal-tar pitch as a binder. While the carbon anode is in service this filler material is calcined, as a result of which binder vapors are given off and a volume reduction of about 50% is experienced.

These and similar known devices for protecting the anode spades or pins do, however, suffer from disadvantages. The protection offered by the collar is markedly reduced as a result of the shrinkage that occurs during the calcination process. Furthermore, the collar which is relatively porous after the calcination process exhibits a pronounced tendency to take up sodium during the electrolytic process. There are also disadvantages associated with the handling of the collar before going into service. The collar is easily displaced in spite of the adjustable side parts; as a result of this, after the filler material has been poured into the collar, the intended thickness of protective medium is not guaranteed around the spades, or the collar no longer rests fully on the anode block and filler material runs out below the collar. Further, the collar is frequently damaged and the filler material spills out during transportation from the filling station to the reduction cell.

The use of filler material in granular form also brings the disadvantage that filler material is lost and falls to the ground where the work force is engaged; there is therefore a danger of workers slipping on the spherical shaped particles.

Also the use of coal-tar pitch as binder for the filler is disadvantageous. Various investigations have shown that coal-tar pitch contains polycylic aromatic hydrocarbons which escape in gaseous form during the manufacture and/or use of the resultant refractory materials made therefrom. The polycyclic aromatic hydrocarbons can be carcinogenic. The binding agent fumes produced during the manufacture of or use of filler materials of the kind mentioned at the start containing coal-tar pitch as binder can therefore represent a health hazard to people and the environment. The work force carrying out the above mentioned duties, and already subjected to dust and noise in the manufacture or filler material, is therefore exposed to an additional hazard.

SUMMARY OF THE INVENTION

The object of the present invention is therefore to develop a collar for protecting the iron spade of an anode rod for a carbon block used as the anode in the electrolytic production of aluminum, such that the said collar at least in part does not exhibit the above mentioned disadvantages and yet can be manufactured simply and economically.

This object is achieved by way of the invention in that the collar features a plurality of, in particular two, shaped carbon blocks each of which features two close fitting end faces and recesses which jointly correspond to the cross-section of the anode spade or pin projecting out of the carbon anode and surround the spade or pin as well as base areas which form a plane that is in contact with the carbon anode.

BRIEF DESCRIPTION OF THE DRAWINGS

Further advantages, features and details are revealed in the following with the aid of exemplified embodiments and the schematic drawings viz.

DETAILED DESCRIPTION

Figure 1:
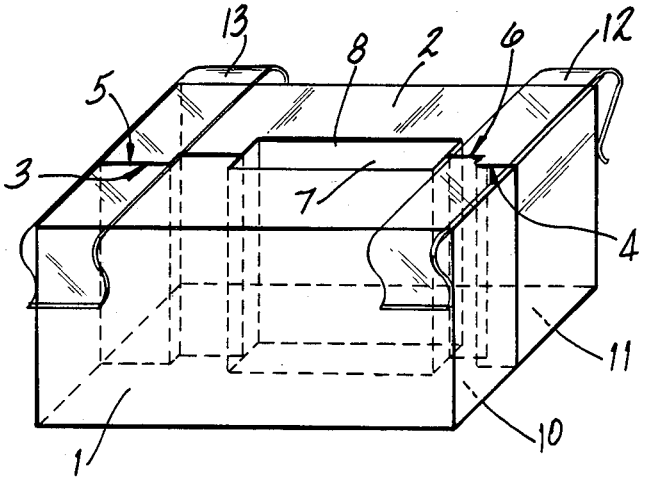
FIGS. 1 and 2: protective collar shown in perspective views.

In principle the outer limits of the collar can be of any dimension that does not hinder the operation of the cell; simple shapes such as rectangles, rhombus, circles or combinations of these are however preferred. The height of the collar is chosen in accordance with the dimensions of the spade or pin as well as the carbon anode and its use, and can in the extreme be the same as the length of spade or pin projecting out of the anode. A collar height typical for the invention is about 200 mm for a length of 260 mm and breadth of 220 mm.

According to a further development of the invention the end faces of the carbon blocks engage in an interlocking manner. For better positioning the end faces and/or the base surfaces can be covered with an adhesive film. Particularly suitable for that purpose is an adhesive which does not exhibit adhesive properties at room temperature and therefore does not hinder the handling of the carbon blocks; after the carbon blocks making up the collar are placed around the spade or pin, however, they bond together at a slightly elevated temperature to form a single block which also bonds to the carbon anode block. It has been found that a low viscosity bitumen is a particularly suitable adhesive for this purpose. By bitumen is to be understood, here and in the following, the substance according to the general definition as laid down in the German Standard DIN No. 55 946.

Clamping means, especially such made of aluminum sheet can be positioned around the carbon blocks in order to help hold them together. Aluminum is particularly suitable here as the metal does not contaminate the bath when it melts and is recovered again in the electrolytic process.

For the manufacture of the individual carbon blocks of the collar it has been found particularly favorable to choose a carbonaceous mass comprising 60–90 wt % of solid carbonaceous material of normal granulometry and 10–40 wt % bitumen as binder. A particularly advantageous carbonaceous mass for manufacturing the carbon blocks is achieved if the mentioned bitumen fraction comprises 70–90% hard bitumen and 10–30 wt % soft bitumen.

By hard bitumen is to be understood here a bitumen which has a softening point, according to the ring and sphere test, of about 80°–110° C., by soft bitumen one with a softening point of about 40°–65° C., and such that the density of both bitumens does not exceed 1.1 g/cm$^3$ (at 25° C.).

In contrast to coal-tar pitch, bitumen contains only extremely low concentrations of polycyclic aromatic hydrocarbons i.e. at a level which does not represent a health hazard to industrial employees.

In particular polycyclic aromatics with 4–6 rings are not to be expected in the vapors given off by the bitumen during the heating-up stage. The vapor given off comprise mainly napthene aromatics and alkyl. A risk of exposure to carcinogenic substances is therefore not present either in the production of the carbonaceous mass or in its processing into carbon blocks or collars or the use of these.

Further practically all of the previously mentioned disadvantages are eliminated.

The carbon blocks are made by pouring the carbon mass into suitable molds and condensing by conventional means to a gross density of about 1.5–1.7 g/cm$^3$. While in service in the reduction process the collar, made up of these individual carbon blocks, is calcined with a very small volume contraction (approx. 6%). Because of the predensification of the carbonaceous mass the pore volume is very much smaller than in state-of-the-art collars. Consequently the uptake of sodium is reduced to such a degree that the collar material remaining after use in the electrolytic process can be recycled to produce new collars or carbon anode blocks. Using protective means prepared by state-of-the-art methods this would be possible only under the penalty of drop in quality due to the high uptake of sodium.

Referring to the drawings, FIG. 1 shows a protective collar with rectangular outer contour comprising two carbon blocks 1 and 2. Each carbon block has two end faces 3, 4 and 5, 6, of which only traces are to be seen on the top and partly at the side, and a straight-line U-shaped recess 7, 8. The recess is slightly larger than the corresponding dimension of the iron spade. The anode spade, which is not shown here, resides in the rectangular shaped channel formed by the recesses 7 and 8, and is of the same but slightly smaller cross-section as the said channel. The end faces 3, 4 and 5, 6 are shaped to be interlocking. Another shape, however, is also within the scope of the invention as that aspect of the shape has the function of enabling the individual carbon blocks 1, 2 to be readily brought into the correct position when placed around the iron spade. Clamps 12, 13 spanning the two carbon blocks, 1, 2 can be provided to maintain this desired positioning. This is particularly advantageous if the interlocking end faces 3, 4 and 5, 6 are not adhesively bonded.

Figure 2:
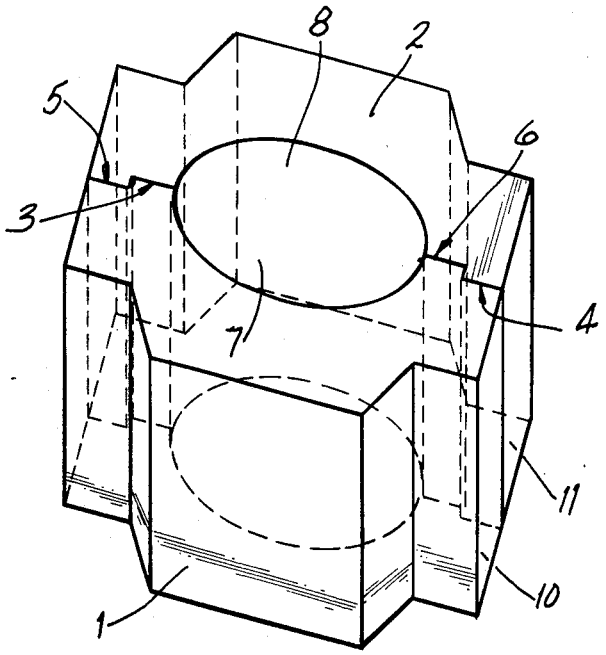

FIG. 2 shows a protective collar which is in principle the same as in FIG. 1. The outer contour, however, is a combination of rectangle and rhombus shapes and the recesses 7, 8 are semi-circular, which makes this version particularly suitable for anode pins as these are usually circular in cross-section. Base areas 10 and 11 of the protective collars shown in FIGS. 1 and 2 form a plane that is in contact with the carbon anode.

Figure 3:
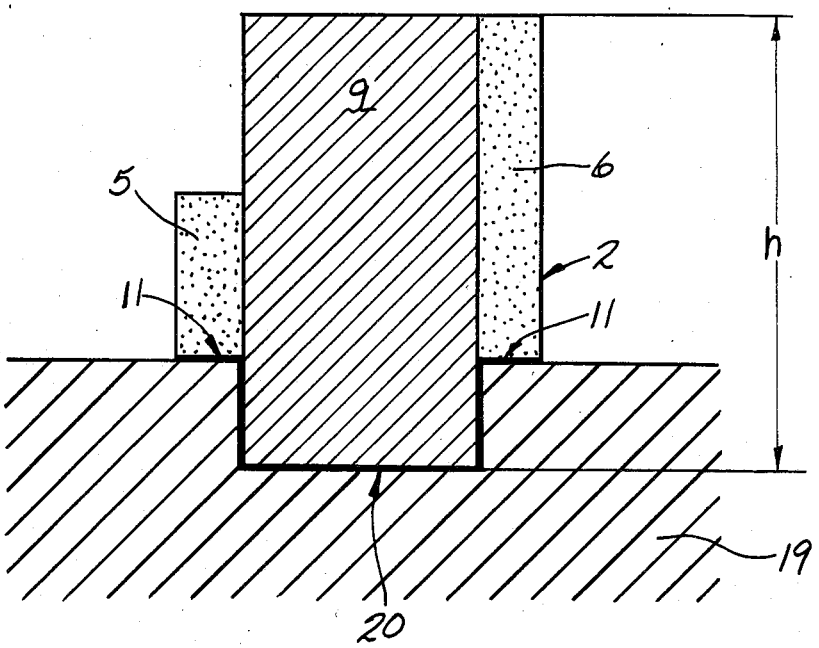
FIGS. 3 and 4: vertical cross-section through anode blocks fitted with protective collars.
Figure 4:
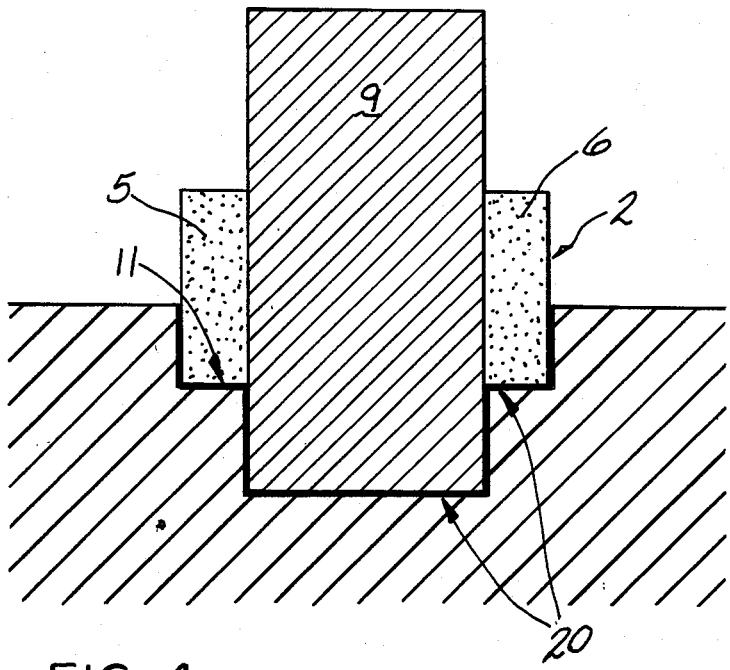

FIGS. 3 and 4 show anodes with different shaped holes for anode spades or pins. In FIG. 3 the anode 19 features a spade hole 20 which is completely filled by the anode spade 9. The anode block of the collar engages the spade 9 at end faces 5 and 6 and rests its base area 11 on the anode 19. The carbon blocks 2 of the collar enclose the free part of the spade 9 up to its full height h.

In FIG. 4 the spade hole 20 is stepped and is such that the lower, narrower part of the hole 20 is for securing the spade 9 in place, while the rest of the space is filled with the carbon blocks 2 of the collar. This version offers the advantage that the protective collar according to the invention can also be employed with spade or pin holes of the type frequently used with state-of-the-art metal collars.

EXAMPLE

A carbonaceous mass is prepared using 67 wt % petroleum coke, 17 wt % collar residue from used anodes, 14 wt % hard bitumen and 2 wt % soft bitumen. A sieve analysis of the solid materials showed a particle size distribution as follows: >8 mm: 5 wt %; 3–8 mm: 24 wt %; 1–3 mm: 22 wt %; <1 mm: 49 wt %. The solid constituents are heated to 160° C. and mixed to a homogeneous mass. Next, hard bitumen which has been heated to 190° C., followed by soft bitumen which has been heated to 90° C. are added slowly and continuously so that the solid particles become coated with the binder. During the addition of the binder and for a further 20 minutes the mass is intensively mixed. After cooling the mass to a temperature suitable for the press used, this is pressed to a gross density of 1.5–1.7 g/cm$^3$.

What is claimed is:

1. In a collar for protecting the anode spade or pin of an anode rod for an anode used in the electrolytic production of aluminum, the improvement which comprises an anode, an anode spade or pin of an anode rod projecting from said anode, a protective collar which surrounds the anode spade or pin projecting from the anode and which includes at least two, shaped carbon blocks each of which feature two close-fitting end faces and recesses which jointly correspond to the cross-section of the anode spade or pin and surround the anode spade or pin, wherein said collar includes base areas which form a plane that is in contact with the anode.

2. Collar according to claim 1 wherein said anode is a carbon anode.

3. Collar according to claim 24 wherein the shaped carbon blocks partly enclose the anode spade or pin.

4. Collar according to claim 1 wherein said end faces engage in an interlocking manner.

5. Collar according to claim 1 including clamps which hold the shaped carbon blocks together.

6. Collar according to claim 5 wherein said clamps are aluminum clamps.

7. Collar according to claim 1 wherein the shaped carbon blocks comprise 60–70 wt % carbonaceous solids and 10–40 wt % bitumen binder.

8. Collar according to claim 7 wherein the binder comprises 70–90 wt % hard bitumen and 10–13 wt % soft bitumen.

9. Collar according to claim 7 wherein the gross density of the shaped carbon blocks lies between 1.3 and 1.7 g/cm$^3$.

10. Collar according to claim 1 wherein the end faces are coated with an adhesive film.

11. Collar according to claim 1 wherein the base areas are coated with an adhesive film.

12. Collar according to claim 10 wherein the adhesive film is of a low viscosity bitumen.

13. Collar according to claim 11 wherein the adhesive film is of a low viscosity bitumen.

* * * * *